US007560205B2

(12) United States Patent
Qi et al.

(10) Patent No.: US 7,560,205 B2
(45) Date of Patent: Jul. 14, 2009

(54) PHOTOCONDUCTIVE IMAGING MEMBERS

(75) Inventors: Yu Qi, Oakville (CA); Nan-Xing Hu, Oakville (CA); Cheng-Kou Hsiao, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 391 days.

(21) Appl. No.: 11/214,917

(22) Filed: Aug. 31, 2005

(65) Prior Publication Data

US 2007/0048636 A1 Mar. 1, 2007

(51) Int. Cl.
*G03G 5/147* (2006.01)

(52) U.S. Cl. ..... 430/58.75; 430/58.2; 430/58.65; 430/66; 430/67

(58) Field of Classification Search ..... 430/58.2, 430/58.65, 58.75, 66, 67; 399/130
See application file for complete search history.

(56) References Cited

U.S. PATENT DOCUMENTS

| | | | | |
|---|---|---|---|---|
| 3,121,006 | A | 2/1964 | Middleton et al. | |
| 4,265,990 | A | 5/1981 | Stolka et al. | |
| 4,286,033 | A | 8/1981 | Meyhart et al. | |
| 4,291,110 | A | 9/1981 | Lee | |
| 4,298,697 | A | 11/1981 | Baczek et al. | |
| 4,338,387 | A | 7/1982 | Hewitt | |
| 4,338,390 | A | 7/1982 | Lu | |
| 4,457,994 | A | 7/1984 | Pai et al. | |
| 4,560,635 | A | 12/1985 | Hoffend et al. | |
| 4,654,284 | A | 3/1987 | Yu et al. | |
| 4,871,634 | A | 10/1989 | Limburg et al. | |
| 5,147,751 | A * | 9/1992 | Kojima et al. | 430/119.71 |
| 5,368,967 | A | 11/1994 | Schank et al. | |
| 5,418,107 | A | 5/1995 | Nealey et al. | |
| 5,702,854 | A | 12/1997 | Schank et al. | |
| 5,709,974 | A | 1/1998 | Yuh et al. | |
| 5,976,744 | A | 11/1999 | Fuller et al. | |
| 2002/0119382 | A1 * | 8/2002 | Nakata et al. | 430/66 |
| 2004/0063013 | A1 * | 4/2004 | Hongo et al. | 430/59.1 |
| 2004/0101774 | A1 * | 5/2004 | Yoshimura et al. | 430/66 |

* cited by examiner

*Primary Examiner*—Mark F Huff
*Assistant Examiner*—Rachel L Burney
(74) *Attorney, Agent, or Firm*—Oliff & Berridge, PLC

(57) ABSTRACT

A photoconductive imaging including at least a substrate, a charge generating layer, a charge transport layer, and an overcoat layer. The overcoat layer includes a crosslinked product of at least a phenolic resin and a phenol compound.

20 Claims, No Drawings

PHOTOCONDUCTIVE IMAGING MEMBERS

TECHNICAL FIELD

Described herein is a phenolic overcoat layer that includes a crosslinked product of at least a phenolic resin and a phenol, and a photoconductive imaging member including the overcoat layer.

BACKGROUND

Photosensitive members such as electrophotographic or photoconductive imaging members, including photoreceptors or photoconductors, typically include a photoconductive layer formed on an electrically conductive substrate or formed on layers between the substrate and photoconductive layer. The photoconductive layer is an insulator in the dark, so that electric charges are retained on its surface. Upon exposure to light, the charge is dissipated, and an image can be formed thereon, developed using a developer material, transferred to a copy substrate, and fused thereto to form a copy or print.

Many advanced imaging systems are based on the use of small diameter photoreceptor drums. The use of small diameter drums places a premium on photoreceptor life. A major factor limiting photoreceptor life in copiers and printers, is wear. The use of small diameter drum photoreceptors exacerbates the wear problem because, for example, 3 to 10 revolutions are required to image a single letter size page. Multiple revolutions of a small diameter drum photoreceptor to reproduce a single letter size page can require up to 1 million cycles from the photoreceptor drum to obtain 100,000 prints, a desirable goal for commercial systems.

For low volume copiers and printers, bias charging rolls (BCR) are desirable because little or no ozone is produced during image cycling. However, the microcorona generated by the BCR during charging damages the photoreceptor, resulting in rapid wear of the imaging surface, for example, the exposed surface of the charge transport layer. More specifically, wear rates can be as high as about 16 microns per 100,000 imaging cycles. Similar problems are encountered with bias transfer roll (BTR) systems.

One approach to achieving longer photoreceptor drum life is to form a protective overcoat on the imaging surface, for example, the charge transporting layer of a photoreceptor. This overcoat layer should satisfy many requirements, including transporting holes, resisting image deletion, resisting wear, and avoidance of perturbation of underlying layers during coating.

Various overcoats employing alcohol soluble polyamides have been proposed. One of the earliest ones is an overcoat comprising an alcohol soluble polyamide without any methyl methoxy groups (ELVAMIDE®) containing N,N'-diphenyl-N,N'-bis(3-hydroxyphenyl)-(1,1'-biphenyl)-4,4'-diamine. This overcoat is described in U.S. Pat. No. 5,368,967, the entire disclosure thereof being incorporated herein by reference.

A crosslinked polyamide overcoat is known, comprising a crosslinked polyamide containing N,N'-diphenyl-N,N'-bis(3-hydroxyphenyl)-(1,1'-biphenyl)-4,4'-diamine, and referred to as LUCKAMIDE®. In order to achieve crosslinking, a polyamide polymer having N-methoxymethyl groups (LUCKAMIDE®) was employed along with a catalyst such as oxalic acid. This tough overcoat is described in U.S. Pat. No. 5,702,854, the entire disclosure thereof being incorporated herein by reference.

Disclosed in U.S. Pat. No. 5,976,744 is an electrophotographic imaging member including a supporting substrate coated with at least one photoconductive layer, and an overcoating layer. The overcoating layer includes hydroxy functionalized aromatic diamine and a hydroxy functionalized triarylamine dissolved or molecularly dispersed in a crosslinked acrylated polyamide matrix. The hydroxy functionalized triarylamine is a compound different from the polyhydroxy functionalized aromatic diamine.

Disclosed in U.S. Pat. No. 5,709,974 is an electrophotographic imaging member including a charge generating layer, a charge transport layer and an overcoating layer. The transport layer includes a charge transporting aromatic diamine molecule in a polystyrene matrix. The overcoating layer includes a hole transporting hydroxy arylamine compound having at least two hydroxy functional groups, and a polyamide film forming binder capable of forming hydrogen bonds with the hydroxy functional groups of the hydroxy arylamine compound.

Disclosed in U.S. Pat. No. 5,368,967 is an electrophotographic imaging member comprising a substrate, a charge generating layer, a charge transport layer, and an overcoat layer comprising a small molecule hole transporting arylamine having at least two hydroxy functional groups, a hydroxy or multihydroxy triphenyl methane, and a polyamide film forming binder capable of forming hydrogen bonds with the hydroxy functional groups such as the hydroxy arylamine and hydroxy or multihydroxy triphenyl methane. This overcoat layer may be fabricated using an alcohol solvent. This electrophotographic imaging member may be used in an electrophotographic imaging process. Specific materials including ELVAMIDE® polyamide and N,N'-diphenyl-N,N'-bis(3-hydroxyphenyl)-(1,1'-biphenyl)-4,4'-diamine and bis-[2-methyl-4-(N-2-hydroxyethyl-N-ethyl-aminophenyl)]-phenylmethane are disclosed in this patent.

Disclosed in U.S. Pat. No.4,871,634 is an electrostatographic imaging member containing at least one electrophotoconductive layer. The imaging member comprises a photogenerating material and a hydroxy arylamine compound represented by a certain formula. The hydroxy arylamine compound can be used in an overcoat with the hydroxy arylamine compound bonded to a resin capable of hydrogen bonding such as a polyamide possessing alcohol solubility.

Disclosed in U.S. Pat. No. 4,457,994 is a layered photosensitive member comprising a generator layer and a transport layer containing a diamine type molecule dispersed in a polymeric binder, and an overcoat containing triphenyl methane molecules dispersed in a polymeric binder.

Disclosed in U.S. Pat. No. 5,418,107 is a process for fabricating an electrophotographic imaging member.

Phenolic overcoat compositions comprising a phenolic resin and a triarylamine hole transport molecule are known. These phenolic overcoat compositions can be cured to form a crosslinked structure.

A photoconductive imaging member having an overcoat layer that has excellent adherence to the charge transport layer is desired. Such an overcoat layer could improve the overall useful life of the photoconductive imaging member.

SUMMARY

In embodiments, described is a photoconductive imaging member comprising a substrate, a charge generating layer, a charge transport layer, and an overcoat layer comprising a crosslinked product of at least a phenolic resin and a phenol compound.

In embodiments, described is an image forming apparatus comprising at least one charging unit, at least one exposing unit, at least one developing unit, a transfer unit, a cleaning unit, and a photoconductive imaging member comprising a substrate, a charge generating layer, a charge transport layer, and an overcoat layer comprising a crosslinked product of at least a phenolic resin and a phenol compound.

In embodiments, described is a method of producing an photoconductive imaging member comprising providing a substrate, forming an underlayer on said substrate, forming a charge generation layer over the underlayer, forming a charge transfer layer over the charge generation layer, and forming an overcoat layer over the charge transfer layer, wherein the overcoat layer comprises the a crosslinked product of a phenolic resin and a phenol compound.

EMBODIMENTS

The present disclosure relates generally to photoconductive imaging members such as photoconductors, photoreceptors and the like, for example which may be used in electrophotographic or xerographic imaging processes The photoconductive imaging members have an overcoat layer that achieves adhesion to the charge transport layer.

The photoconductive imaging members are, in embodiments, multilayered photoreceptors that comprise a substrate, an optional conductive layer, an optional undercoat layer, an optional adhesive layer, a charge generating layer, a charge transport layer, and a phenolic overcoat layer. The phenolic overcoat layer comprises the crosslinked product of at least a phenolic resin and a phenol compound. The phenolic overcoat layer can further include a tertiary aryl amine hole transport molecule.

Illustrative examples of substrate layers selected for the photoconductive imaging members, and which substrates may be known substrates and which can be opaque or substantially transparent, comprise a layer of insulating material including inorganic or organic polymeric materials, such as MYLAR®, a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on a number of factors, including the characteristics desired and economical considerations, thus this layer may be of substantial thickness, for example over 3,000 microns, such as from about 3,000 to about 7,000 microns or of minimum thickness, such as at least about 50 microns, providing there are no significant adverse effects on the member. In embodiments, the thickness of this layer is from about 75 microns to about 300 microns.

If a conductive layer is used, it is positioned over the substrate. The term "over" as used herein in connection with many different types of layers, as well as the term "under," should be understood as not being limited to instances where the specified layers are contiguous. Rather, the term refers to relative placement of the layers and encompasses the inclusion of unspecified intermediate layers between the specified layers.

Suitable materials for the conductive layer include aluminum, zirconium, niobium, tantalum, vanadium, hafnium, titanium, nickel, stainless steel, chromium, tungsten, molybdenum, copper, and the like, and mixtures and alloys thereof.

The thickness of the conductive layer is, in one embodiment, from about 20 angstroms to about 750 angstroms, and, in another from about 50 angstroms to about 200 angstroms, for a suitable combination of electrical conductivity, flexibility, and light transmission. However, the conductive layer can, if desired, be opaque.

The conductive layer can be applied by known coating techniques, such as solution coating, vapor deposition, and sputtering. In embodiments, an electrically conductive layer is applied by vacuum deposition. Other suitable methods can also be used.

If an undercoat layer is employed, it may be positioned over the substrate, but under the charge generating layer. The undercoat layer is at times referred to as a hole-blocking layer in the art.

Suitable undercoat layers for use herein include polymers, such as polyvinyl butyral, epoxy resins, polyesters, polysiloxanes, polyamides, polyurethanes, and the like, nitrogen-containing siloxanes or nitrogen-containing titanium compounds, such as trimethoxysilyl propyl ethylene diamine, N-beta (aminoethyl) gamma-aminopropyl trimethoxy silane, isopropyl 4-aminobenzene sulfonyl titanate, di(dodecylbenezene sulfonyl) titanate, isopropyl di(4-aminobenzoyl) isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. No. 4,338,387, U.S. Pat. No. 4,286,033 and U.S. Pat. No. 4,291,110.

The undercoat layer may be applied as a coating by any suitable conventional technique such as spraying, die coating, dip coating, draw bar coating, gravure coating, silk screening, air knife coating, reverse roll coating, vacuum deposition, chemical treatment and the like. For convenience in obtaining layers, the undercoat layers may be applied in the form of a dilute solution, with the solvent being removed after deposition of the coating by conventional techniques such as by vacuum, heating and the like. Drying of the deposited coating may be achieved by any suitable technique such as oven drying, infrared radiation drying, air drying and the like.

In fabricating a photoconductive imaging member, a charge generating layer is deposited and a charge transport layer may be deposited onto the substrate surface either in a laminate type configuration where the charge generating layer and charge transport layer are in different layers or in a single layer configuration where the charge generating layer and charge transport layer are in the same layer along with a binder resin. In embodiments, the charge generating layer is applied prior to the charge transport layer.

The charge generating layer is positioned over the undercoat layer. If an undercoat layer is not used, the charge generating layer is positioned over the substrate. In embodiments, the charge generating layer is comprised of amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generating layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is desired for photoreceptors exposed to low-cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film-forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

A photogenerating composition or pigment may be present in the resinous binder composition in various amounts. Generally, however, from about 5 percent by volume to about 90 percent by volume of the photogenerating pigment is dispersed in about 10 percent by volume to about 95 percent by volume of the resinous binder, and typically from about 20 percent by volume to about 30 percent by volume of the photogenerating pigment is dispersed in about 70 percent by volume to about 80 percent by volume of the resinous binder composition. The photogenerator layers can also fabricated by vacuum sublimation in which case there is no binder.

In embodiments, any suitable technique may be used to mix and thereafter apply the photogenerating layer coating mixture. Typical application techniques include spraying, dip coating, roll coating, wire wound rod coating, vacuum sublimation and the like. For some applications, the charge generating layer may be fabricated in a dot or line pattern. Removing of the solvent of a solvent coated layer may be effected by any suitable technique such as oven drying, infrared radiation drying, air drying and the like. In embodiments, the charge generating layer is from about 0.1 micrometers to about 100 micrometers thick, for example from about 0.1 micrometers to about 50 micrometers.

In embodiments, a charge transport layer may be employed. The charge transport layer may comprise a charge-transporting molecule, for example, a small molecule, dissolved or molecularly dispersed in a film forming electrically inert polymer such as a polycarbonate. The expression charge transporting "small molecule" is defined herein as a monomer that allows the free charge photogenerated in the generator layer to be transported across the transport layer. In embodiments, the term "dissolved" refers to, for example, forming a solution in which the molecules are distributed in the polymer to form a homogeneous phase. In embodiments, the expression "molecularly dispersed" refers to a dispersion in which a charge transporting small molecule dispersed in the polymer, for example on a molecular scale.

Any suitable charge transporting or electrically active small molecule may be employed in the charge transport layer.

Typical charge transporting molecules include, for example, pyrene, carbazole, hydrazone, oxazole, oxadiazole, pyrazoline, arylamine, arylmethane, benzidine, thiazole, stilbene and butadiene compounds; pyrazolines such as 1-phenyl-3-(4'-diethylaminostyryl)-5-(4'-diethylamino phenyl) pyrazoline; diamines such as N,N'-diphenyl-N,N'-bis(3-methylphenyl)-(1,1'-biphenyl)-4,4'-diamine; hydrazones such as N-phenyl-N-methyl-3-(9-ethyl)carbazyl hydrazone and 4-diethyl amino benzaldehyde-1,2-diphenyl hydrazone; oxadiazoles such as 2,5-bis (4-N,N'-diethylaminophenyl)-1,2,4-oxadiazole; poly-N-vinylcarbazole, poly-N-vinylcarbazole halide, polyvinyl pyrene, polyvinylanthracene, polyvinylacridine, a pyrene-formaldehyde resin, an ethylcarbazole-formaldehyde resin, a triphenylmethane polymer and polysilane, and the like.

In embodiments, to minimize or avoid cycle-up in machines with high throughput, the charge transport layer may be substantially free (e.g., from zero to less than about two percent by weight of the charge transport layer) of triphenylmethane. As indicated above, suitable electrically active small molecule charge transporting compounds are dissolved or molecularly dispersed in electrically inactive polymeric film forming materials.

An exemplary small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material.

In embodiments, the charge transport layer may contain an active aromatic diamine molecule, which enables charge transport, dissolved or molecularly dispersed in a film forming binder. An exemplary charge transport layer is disclosed in U.S. Pat. No. 4,265,990, the entire disclosure of which is incorporated herein by reference.

Any suitable electrically inactive resin binder that is ideally substantially insoluble in the solvent such as alcoholic solvent used to apply the optional overcoat layer may be employed in the charge transport layer. Typical inactive resin binders include polycarbonate resin, polyester, polyarylate, polyacrylate, polyether, polysulfone, and the like. Molecular weights can vary, for example from about 20,000 to about 150,000. Exemplary binders include polycarbonates such as poly (4,4'-isopropylidene-diphenylene)carbonate (also referred to as bisphenol-A-polycarbonate); polycarbonate, poly (4,4'-cyclohexylidinediphenylene) carbonate (referred to as bisphenol-Z polycarbonate), poly (4,4'-isopropylidene-3,3'-dimethyl-diphenyl)carbonate (also referred to as bisphenol-C-polycarbonate), and the like.

Any suitable charge transporting polymer may also be utilized in the charge transporting layer of this disclosure. The charge transporting polymer should be insoluble in the solvent employed to apply the overcoat layer. These electrically active charge transporting polymeric materials should be capable of supporting the injection of photogenerated holes from the charge generating material and be capable of allowing the transport of these holes therethrough.

Any suitable technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable technique such as oven drying, infrared radiation drying, air drying and the like.

Generally, the thickness of the charge transport layer is from about 10 to about 100 micrometers, but a thickness outside this range can also be used. A charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of a charge transport layer to the charge generating layers may be maintained from about 2:1 to 200:1, and in some instances as great as 400:1. Typically, a charge transport layer is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

An overcoat layer is formed over the charge transport layer. This protective overcoat layer may increase the extrinsic life of a photoreceptor device and may maintain good printing quality or deletion resistance when used in an image forming apparatus.

In embodiments, the overcoat layer is a phenolic overcoat composition comprising the crosslinked product of at least a phenolic resin and a

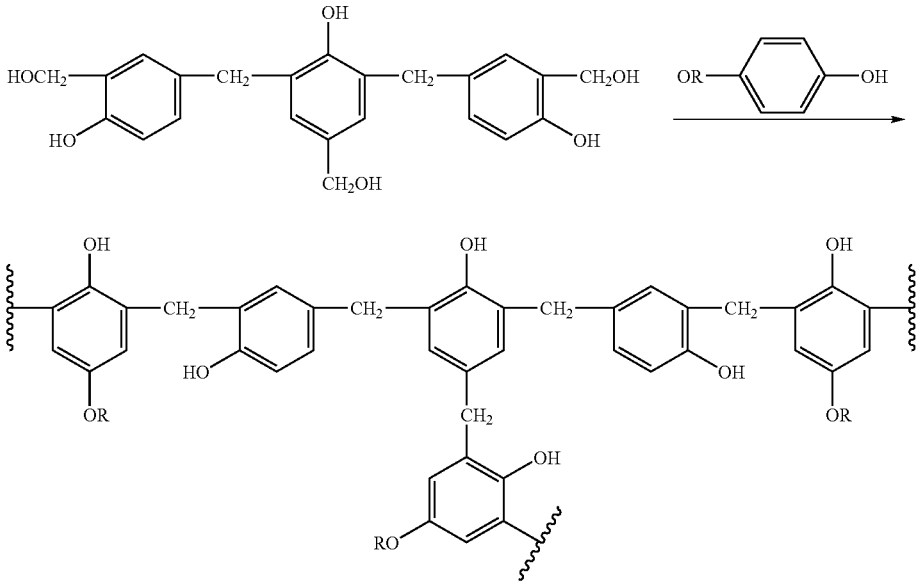

phenol compound. The phenol appears to act as an adhesive promoter between the phenolic overcoat layer and the charge transport layer.

The overcoat layer described herein may be continuous and may have a thickness of less than about 50 micrometers, for example from about 0.1 micrometers to about 50 micrometers, for example from about 0.1 micrometers to about 15 micrometers.

In embodiments, the phenolic overcoat layer may be formed by the reaction of the phenol resin and the phenol compound to form a crosslinked product. The phenol compound may function as starting material for the phenolic resin and to improve the adhesion of the phenolic overcoat to the charge transport layer of the photoconductive imaging member. One possible reaction of the phenol resin and the phenol compound to form a crosslinked compound is as follows.

In embodiments, the phenolic overcoat layer may further include a tertiary arylamine. This tertiary arylamine functions as hole transport molecule. If a tertiary arylamine is present in the overcoat layer, it may optionally be part of the crosslinked structure.

In embodiments, the phenolic resin is a resole-type phenolic resin. The molecular weight of the resin ranges from about 300 to about 50,000. The phenolic resins that may be employed herein include, for example, phenolic resins such as PL4852 (Gun'ei Kagaku Kogyo K. K.), formaldehyde polymers with phenol, p-tert-butylphenol and cresol, such as VARCUM® 29159 and 29101 (OxyChem Company) and DURITE® 97 (Borden Chemical), formaldehyde polymers with ammonia, cresol and phenol, such as VARCUM® 29112 (OxyChem Company), formaldehyde polymers with 4,4° -(1-methylethylidene) bisphenol, such as VARCUM® 29108 and 29116 (OxyChem Company), formaldehyde polymers with cresol and phenol, such as VARCUM® 29457 (OxyChem Company), DURITE® SD-423A, SD-422A (Borden Chemical), or formaldehyde polymers with phenol and p-tert-butylphenol, such as DURITE® ESD 556C (Borden Chemical). In embodiments, the overcoat layer may be comprised of from about 10 wt. % to about 70 wt. % phenolic resin, for example from about 30 wt. % to about 65 wt. % of the overcoat layer.

The phenol used herein may have a generic formula of:

$$(HO)_y—Ar—(OR)_x$$

wherein Ar represents an aryl group having C6 to C30, R represents an alkyl group having from 1 to about 30 carbon atoms, a polyester, a siloxane-containing group or —$[C_nH_{2n}O]$-G, wherein x is an integer from 1 to about 15, y is an integer from 1 to about 5, n is an integer from 1 to about 6 and G represents a hydrogen atom or an aliphatic group having from 1 to about 15 carbon atoms. In embodiments, the siloxane-containing group may be an alkoxysilane such as —$Si(OCH_3)_3$, —$SiMe(OCH_3)_2$, —$SiMe_2(OCH_3)$, —$Si(OCH_2CH_3)_3$, and the like, a polydimethylsiloxane, a polydiphenylsiloxane, or the like.

In embodiments, the phenol may be an alkoxyphenol. Examples of alkoxyphenols suitable for use herein include, for example, 2-methoxyphenol, 2-ethoxyphenol, 2-isopropoxy-phenol, 4-ethoxyphenol, 4-methoxyphenol, mono-tert-butyl-4-methoxyphenol and di-tert-butyl-4-methoxyphenol, 3-methoxyphenol, 3-(trifluoromethyoxy)phenol, guaiacol, 4-(trifluoromethoxy)phenol, 4-propoxyphenol, 4-butoxyphenol, 4-hexyloxyphenol, 4-heptyloxyphenol, 3,4,5-trimethoxyphenol, 2,3-dimethoxyphenol, 3,4-dimethoxyphenol, 3,5-dimethoxyphenol, 3-methoxycatechol, 5-methoxyresorcinol, methoxyhydroquinone, 7-methoxy-2-naphthol, 4-methoxy-1-naphthol, and the like.

In embodiments, the overcoat may comprise from about 1 wt. % to about 30 wt. % phenol therein, such as from about 2 wt % to about 15 wt. % of the overcoat layer.

In embodiments, the overcoat layer further comprises a tertiary arylamine, for example a tertiary arylamine having a functional group capable of reacting with the phenolic resin. Examples of the functional group on the tertiary amine include a phenol group, a hydroxyl group, an acetyl group, an alkoxy group, a melamine group, and the like.

In embodiments, the tertiary arylamine may have the generic formula of:

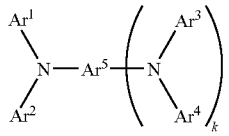

wherein $Ar^1$, $Ar^2$, $Ar^3$ and $Ar^4$ each independently represent a substituted or unsubstituted aryl group having C6 to C30, $Ar^5$ represents a substituted or unsubstituted aryl or arylene group having C6 to C60, and k is 0 or 1. In embodiments, at least one of $Ar^1$, $Ar^2$, $Ar^3$ and $Ar^4$ is connected to the functional group of the tertiary arylamine.

Examples of tertiary arylamines include, but are not limited to, the formulas set forth below.

(II-A)

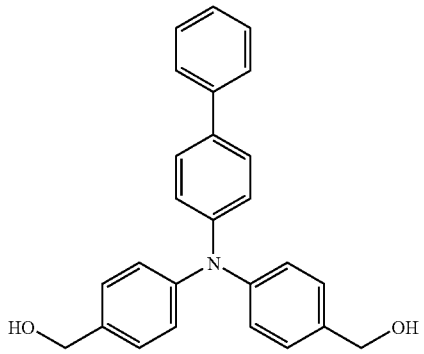

(II-B)

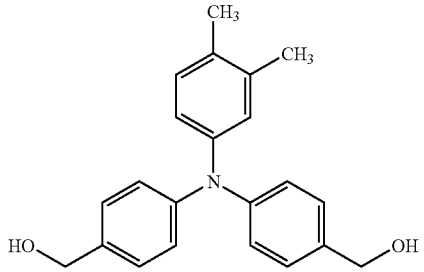

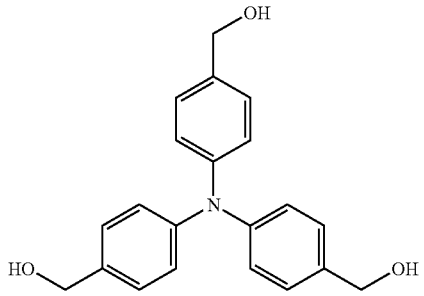

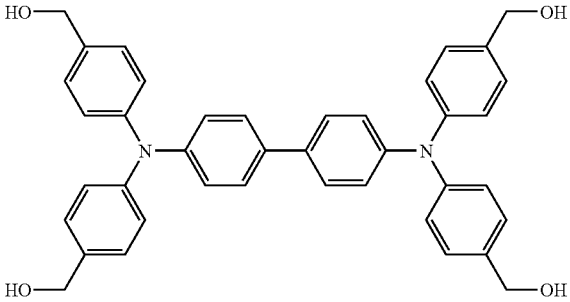

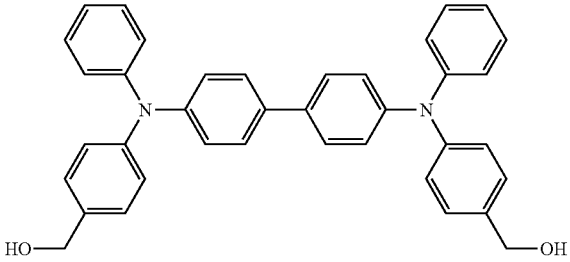

-continued

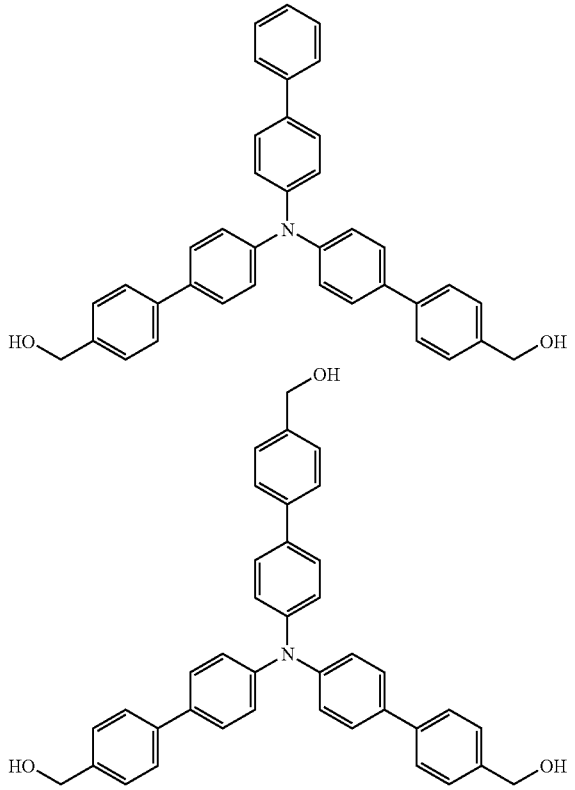

In embodiments, the overcoat layer is may be comprised of from about 3 wt. % to about 80 wt. % tertiary arylamine hole transport molecule, for example from about 3 wt. % to about 40 wt. % of the overcoat layer.

The polymer binder for the overcoat layer may include one or more of thermoplastic and thermosetting resins such as polyamide, polyurethane, polyvinyl acetate, polyvinyl butyral, polysiloxane, polyacrylate, polyvinyl acetal, phenylene oxide resins, terephthalic acid resins, phenoxy resin, epoxy resin, acrylonitrile copolymer, cellulosic film former, poly(amideimide) and melamine-formaldehyde resin and the like. These polymers may be block, random or alternating copolymers. The polymer binder such as polyvinylbutyral (PVB) may provide a desired rheology for coating, and may improve the coating quality of the overcoat film.

In embodiments, the overcoat layer is comprised of from about 1 wt. % to about 20 wt. % polymer binders, such as from about 3 wt. % to about 10 wt. % polymer binders, of the overcoat layer.

Examples of solvents that can be selected for use as coating solvents for the overcoat layer are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, 1-butanol, amyl alcohol, 1-methoxy-2-propanol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

In embodiments, the overcoat layer is prepared by any suitable technique, such as mixing all of the components together. The overcoat layer coating mixture is then applied by any suitable application technique, such as spraying dip coating, roll coating, wire wound rod coating, and the like. The deposited overcoat layer may be dried by any suitable technique, such as oven drying, infrared radiation drying, and the like. The reaction between the phenolic resin and phenol compound to form the crosslinked overcoat layer may occur when drying the deposited overcoat layer.

The overcoat layer disclosed herein achieves excellent adhesion to the charge transport layer of the photoconductive imaging member without substantially negatively affecting the electrical performance of the imaging member to an unacceptable degree.

Additionally, adhesive layers can be provided, if necessary or desired, between any of the layers in the photoreceptors to ensure adhesion of any adjacent layers. Alternatively, or in addition, adhesive material can be incorporated into one or both of the respective layers to be adhered. Such optional adhesive layers may have a thickness of about 0.001 micrometer to about 0.2 micrometer. Such an adhesive layer can be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include film-forming polymers, such as polyester, DuPont 49,000 (available from E. I. DuPont de Nemours & Co.), VITEL PE-100 (available from Goodyear Tire and Rubber Co.), polyvinyl butyral, polyvinyl pyrrolidone, polyurethane, polymethyl methacrylate, and the like.

Optionally, an anti-curl backing layer may be employed to balance the total forces of the layer or layers on the opposite side of the supporting substrate layer. An example of an anti-curl backing layer is described in U.S. Pat. No. 4,654,284, the entire disclosure of which is incorporated herein by reference. A thickness from about 70 to about 160 micrometers may be a satisfactory range for flexible photoreceptors.

Processes of imaging, especially xerographic imaging, and printing, including digital, are also encompassed herein. More specifically, the photoconductive imaging members can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this disclosure are useful in color xerographic applications, particularly high-speed color copying and printing processes.

Also included in the present disclosure are methods of imaging and printing with the photoconductive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto.

The following Examples are submitted to illustrate embodiments of the present disclosure.

EXAMPLE 1

Photoreceptor drum preparation

A titanium oxide/phenolic resin dispersion is prepared by ball milling 15 grams of titanium dioxide (STR60N™, Sakai Company) and 20 grams of the phenolic resin (VARCUM™

29159, OxyChem Company, Mw about 3,600, viscosity about 200 cps) in a mixture of 7.5 grams of 1-butanol and 7.5 grams of xylene, with 120 grams of 1 millimeter diameter sized $ZrO_2$ beads for 5 days. Separately, a slurry of $SiO_2$ and a phenolic resin is prepared by adding 10 grams of $SiO_2$ (P100, Esprit) and 3 grams of the above phenolic resin into a mixture of 19.5 grams of 1-butanol and 19.5 grams of xylene.

The resulting titanium dioxide dispersion is filtered with a 20 micrometer pore size nylon cloth. The filtrate is measured with Horiba Capa 700 Particle Size Analyzer, to obtain a median $TiO_2$ having a particle size of 50 nanometers in diameter and a surface area of 30 $m^2$/gram with reference to the above $TiO_2$/VARCUM dispersion. Additional solvents of 5 grams of 1-butanol, 5 grams of xylene, 2.6 grams of bisphenol S (4,4'-sulfonyldiphenol), and 5.4 grams of the above prepared $SiO_2$VARCUM slurry are added to 50 grams of the above resulting titanium dioxide/VARCUM dispersion. This is referred to as the coating dispersion.

The aluminum drum, cleaned with detergent and rinsed with deionized water, is then dip coated with the coating dispersion at a pull rate of 160 millimeters/minute. Subsequently the aluminum drum is dried at 160° C. for 15 minutes, which results in an undercoat layer (UCL) having $TiO_2/SiO_2$/VARCUM/bisphenol S with a weight ratio of about 52.7/3.6/34.5/9.2 and a thickness of 3.5 microns.

A 0.5 micron thick photogenerating layer is then dip coated on top of the above generated undercoat layer from a dispersion of Type V hydroxygallium phthalocyanine (12 parts), an alkylhydroxy gallium phthalocyanine (3 parts), and a vinyl chloride/vinyl acetate copolymer, VMCH ($M_n$=27,000, about 86 weight percent of vinyl chloride, about 13 weight percent of vinyl acetate and about 1 weight percent of maleic acid) available from Dow Chemical (10 parts), dispersed in n-butylacetate (475 parts).

Subsequently, a 24 μm thick charge transport layer is dip coated on top of the photogenerating layer from a solution of N,N'-diphenyl-N,N-bis(3-methylphenyl)-1,1'-biphenyl-4,4'-diamine (82.3 parts), 2,6-Di-tert-butyl-4methylphenol (BHT) from Aldrich and a polycarbonate (2.1 parts), PCZ-400 [poly(4,4'-dihydroxy-diphenyl-1-1-cyclohexane), $M_w$=40,000] available from Mitsubishi Gas Chemical Company, Ltd. (123.5 parts) in a mixture of tetrahydrofuran (THF) (546 parts) and monochlorobenzene (234 parts). The charge transport layer is then dried at 115° C. for 60 minutes.

EXAMPLE 2

Flexible Belt Photoreceptor Preparation

A barrier layer of hydrolyzed gamma aminopropyltriethoxysilane having a thickness of 0.005 micron is coated by the dry bar technique onto a 75 micron thick titanized MYLAR® substrate. The barrier layer coating composition is prepared by mixing 3-aminopropyltriethoxysilane with ethanol in a 1:50 volume ratio. The coating is allowed to dry for 5 minutes at room temperature, which is followed by curing for 10 minutes at 110° C. in a forced air oven.

On top of the barrier layer is coated a 0.05 micron thick adhesive layer prepared from a solution of 2 weight percent of a DuPont 49K (49,000) polyester in dichloromethane. A 0.2 micron photogenerating layer is then coated on top of the adhesive layer with a wire wound rod from a dispersion of hydroxy gallium phthalocyanine Type V (22 parts) and a vinyl chloride/vinyl acetate copolymer, specifically VMCH ($M_n$=27,000, about 86 weight percent of vinyl chloride, about 13 weight percent of vinyl acetate and about 1 weight percent of maleic acid) available from Dow Chemical (18 parts), dispersed in of n-butylacetate (960 parts), followed by drying at 100° C. for 10 minutes.

Subsequently, a 24 μm thick charge transport layer is coated on top of the photogenerating layer by a draw bar from a solution of N,N'-diphenyl-N,N-bis(3-methylphenyl)-1,1'-biphenyl-4,4'-diamine (67.8 parts), 2,6-Di-tert-butyl-4methylphenol (BHT) from Aldrich and a polycarbonate (1.7 parts), PCZ-400 [poly(4,4'-dihydroxy-diphenyl-1-1-cyclohexane), $M_w$=40,000] available from Mitsubishi Gas Chemical Company, Ltd. (102 parts) dispersed in a mixture of tetrahydrofuran (THF) (410 parts) and of monochlorobenzene (410 parts). The charge transport layer is then dried at 115° C. for 60 minutes.

COMPARATIVE EXAMPLE AND EXAMPLES 3 AND 4

Overcoat Solution Preparation and Coating

A series of mixtures containing phenolic resin, triphenylamine-($CH_2OH_2$), 4-ethoxyphenol, polyvinylbutyral (BX-L®, manufactured by Sekisui Chemical Co., Ltd.) and 1-butanol are weighed according to the formulations in Table 1 and mixed for three hours. After filtration through a 0.45 μm syringe filter, the overcoat solution, e.g., Comparative Example (overcoat layer 1), Example 3 (overcoat layer 2) and Example 4 (overcoat layer 3), are coated on the top of a photoreceptor (the photoreceptor used being the same for each overcoat layer). Comparative Example 1 contains no adhesive promoter and none of the polymer binder. Example 3 and Example 4 contain 2.74% and 1% of 4-ethoxyphenol by weight of solids, respectively, and 5% of BX-L® by weight of solids. The coated photoreceptor devices are heated in an oven at 130° C. for ten minutes. Further, the photoreceptor devices are resistant to organic solvents such as methanol, acetone, etc.

TABLE 1

| Substance | Comparative Example | Example 3 | Example 4 |
|---|---|---|---|
| Phenolic resin | 12% | 10% | 9% |
| 4-ethoxyphenol | 0% | 1% | 2% |
| TPA-$(CH_2OH)_2$ | 8% | 8% | 8% |
| BX-L | 0% | 1% | 1% |
| 1-butanol | 80% | 80% | 80% |

Peeling Tests:

A strip of SCOTCH™ tape is adhered on the surface of the photoreceptor having an overcoat layer on top. After the SCOTCH™ tape is adhered on the surface of the photoreceptor thoroughly, the SCOTCH™ tape is quickly peeled off from one end of the testing device. The results are shown in Table 2. Example 3 and Example 4 have very strong adhesion to the charge transport layer, while the adhesion of Comparative Example to the charge transport layer is rather weak.

TABLE 2

| Time of Pulling | Comparative Example | Example 3 | Example 4 |
|---|---|---|---|
| 6 times | Peeled Off | No Change | No Change |
| 25 times | N/A | No Change | No Change |

Coating Quality:

The improvement of coating quality with the phenolic overcoat layers Example 3 and Example 4 as compared to overcoat layer Comparative Example are obvious even with the simple observation by human eyes. Comparative Example shows many defects on the surface while Example 3 and Example 4 both show smooth surface without defects.

Photoreceptor Device Evaluation:

The xerographic electrical properties of the above prepared photoconductive imaging members and other similar members can be determined by known means, including electrostatically charging the surfaces thereof with a corona discharge source until the surface potentials, as measured by a capacitively coupled probe attached to an electrometer, attain an initial value (Vo) of about −800 volts. After resting for 0.5 second in the dark, the charged members attain a surface potential (Vddp, dark development potential).

Each photoconductive imaging member is then exposed to light from a filtered Xenon lamp thereby inducing a photodischarge which results in a reduction of surface potential (Vbg value, background potential). The percent of photodischarge is calculated as 100×(Vddp−Vbg)/Vddp.

The desired wavelength and energy of the exposed light is determined by the type of filters placed in front of the lamp. The monochromatic light photosensitivity is determined using a narrow band-pass filter. The photosensitivity of the imaging member is usually provided in terms of the amount of exposure energy (ergs/cm$^2$) required to achieve 50 percent photodischarge from Vddp to half of its initial value ($E_{1/2}$). The higher the photosensitivity, the smaller is the $E_{1/2}$ value. The $E_{7/8}$ value corresponds to the exposure energy required to achieve ⅞ photodischarge from Vddp.

The device is finally exposed to an erase lamp of appropriate light intensity and any residual potential (Vresidual) is measured. The imaging members are tested with a monochromatic light exposure at a wavelength of 780+/−10 nanometers and an erase light with the wavelength of 600 to 800 nanometers and intensity of 200 ergs·cm$^2$.

The following Table 3 summarizes the electrical performance for these devices. Table 3 clearly demonstrates that the electrical properties of the photoconductive imaging members are not adversely affected by an overcoat layer.

TABLE 3

| Device | Vddp (−V) | E½ (Ergs/cm$^2$) | Dark Decay (V@ 500 ms) | Vr (V) |
|---|---|---|---|---|
| Control Device | 814 | 1.24 | 20 | 14 |
| Device with Comparative Example (1.2 μm) | 815 | 1.30 | 20 | 13 |
| Device with Example 3 (1.0 μm) | 815 | 1.30 | 22 | 14 |
| Device with Example 4 (1.2 μm) | 815 | 1.30 | 21 | 14 |

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A photoconductive imaging member comprising:

a substrate;

a charge generating layer;

a charge transport layer; and an overcoat layer comprising a crosslinked product of at least a phenolic resin and a phenol compound represented by:

$$(HO)_y—Ar—(OR)_x$$

wherein Ar represents an aryl group, R represents an alkyl group having from 1 to about 30 carbon atoms, a polyester, a siloxane-containing group or $[C_nH_{2n}O]$-G, x is an integer from 1 to about 15 and y is an integer from 1 to about 5, and wherein n is an integer from 1 to about 6 and G represents a hydrogen atom or an aliphatic group having from 1 to about 15 carbon atoms.

2. The photoconductive imaging member according to claim 1, wherein the phenolic resin is a resole-type phenolic resin.

3. The photoconductive imaging member according to claim 1, wherein the phenol is an alkoxyphenol selected from the group consisting of 2- methoxyphenol, 2-ethoxyphenol, 2-isopropoxy-phenol, 4-ethoxyphenol, 4-methoxyphenol, mono-tert-butyl-4-methoxyphenol and di-tert-butyl-4-methoxyphenol, 3-methoxyphenol, 3- (trifluoromethyoxy)phenol, guaiacol, 4-(trifluoromethoxy)phenol, 4-propoxyphenol, 4-butoxyphenol, 4-hexyloxyphenol, 4-heptyloxyphenol, 3 , 4,5-trimethoxyphenol, 2, 3 -dimethoxyphenol, 3 , 4-dimethoxyphenol, 3 ,5-dimethoxyphenol, 3-methoxycatechol, 5-methoxyresorcinol, methoxyhydroquinone, 7-methoxy-2-naphthol and 4-methoxy- 1 -naphthol.

4. The photoconductive imaging member according to claim 1, wherein the overcoat layer further comprises a hole transport material comprised of a tertiary arylamine.

5. The photoconductive imaging member according to claim 4, wherein the tertiary arylamine further contains a functional group which is capable of reacting with the phenolic resin.

6. The photoconductive imaging member according to claim 5, wherein the functional group is selected from the group consisting of a phenol group, a hydroxyl group, an acetyl group, an alkoxy group, and a melamine group.

7. The photoconductive imaging member according to claim 5, wherein the tertiary arylamine is represented by

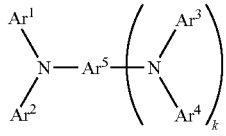

wherein $Ar^1$, $AR^2$, $Ar^3$ and $Ar^4$ each independently represent a substituted or unsubstituted aryl group, Ar5 represents a substituted or unsubstituted aryl or arylene group, and k is 0 or 1.

8. The photoconductive imaging member according to claim 7, wherein at least one of $Ar^1$, $Ar^2$, $Ar^3$ and $Ar^4$ is connected to the functional group.

9. The photoconductive imaging member according to claim 1, wherein the overcoat layer further comprises a polymer binder selected from the group consisting of polyamide, polyurethane, polyvinyl acetate, polyvinyl butyral, polysiloxane, polyacrylate, polyvinyl acetal, phenylene oxide resins, terephthalic acid resins, phenoxy resin, epoxy resin, acrylonitrile copolymer, cellulosic film former, and poly(amideimide).

10. The photoconductive imaging member according to claim 9, wherein the polymer binder is polyvinyl butyral.

11. The photoconductive imaging member according to claim 1, wherein the overcoat layer further comprises a tertiary arylamine having a hydroxyl functional group and a polymer binder.

12. The photoconductive imaging member according to claim 11, wherein the phenolic resin comprises from about 10 weight % to about 70 weight % of the overcoat layer, the phenol compound comprises from about 1 weight % to about 30 weight % of the overcoat layer, the tertiary arylamine comprises from about 3 weight % to about 80 weight % of the overcoat layer, and the polymer binder comprises from about 1 weight % to about 10 weight % of the overcoat layer.

13. The photoconductive imaging member according to claim 1, wherein the overcoat layer has a thickness of from about 0.1 micrometers to about 15 micrometers.

14. The photoconductive imaging member according to claim 1, wherein the charge generating layer and the charge transport layer are together in a single layer.

15. An image forming apparatus comprising:

at least one charging unit, at least one exposing unit, at least one developing unit, a transfer unit, a cleaning unit, and a photoconductive imaging member comprising a substrate, a charge generating layer, a charge transport layer, and an overcoat layer comprising at least a crosslinked product of a phenolic resin and a phenol compound represented by:

$$(HO)_y—AR—(OR)_x$$

wherein Ar represents an aryl group, R represents an alkyl group having from 1 to about 30 carbon atoms, a polyester, a siloxane-containing group or $-[C_nH_{2n}O]-G$, x is an integer from 1to about 15 and y is an integer from 1 to about 5, and wherein n is an integer from 1 to about 6 and G represents a hydrogen atom or an aliphatic group having from 1 to about 15 carbon atoms.

16. The image forming apparatus according to claim 15, wherein the photoconductive imaging member further comprises a tertiary arylamine.

17. The image forming apparatus according to claim 15, wherein the charging unit is a bias charging roll.

18. The image forming apparatus according to claim 15, wherein the transfer unit is an intermediate transfer body for temporarily transferring a toner image formed on the photoconductive imaging member.

19. The image forming apparatus according to claim 15, comprising a plurality of photoconductive imaging members arranged along an intermediate transfer body.

20. A method of producing an electrophotographic photoreceptor comprising:

providing a substrate;

forming an underlayer on said substrate;

forming a charge generating layer over the underlayer;

forming a charge transport layer over the charge generating layer; and forming an overcoat layer over the charge transport layer;

wherein the overcoat layer comprises the a crosslinked product of at least a phenolic resin and a phenol compound represented by:

$$(HO)_y—Ar—(OR)_x$$

wherein Ar represents an aryl group, R represents an alkyl group having from 1 to about 30 carbon atoms, a polyester, a siloxane-containing group or $-[C_nH_{2n}O]-G$,x is an integer from 1 to about 15 and y is an integer from 1 to about 5, and wherein n is an integer from 1 to about 6 and G represents a hydrogen atom or an aliphatic group having from 1 to about 15 carbon atoms.

* * * * *